United States Patent [19]

Kondo

[11] 4,095,411

[45] Jun. 20, 1978

[54] ELECTRONIC WRISTWATCH HAVING AN ALARM DEVICE

[75] Inventor: Kenichi Kondo, Tokyo, Japan

[73] Assignee: Kabushiki Kaisha Daini Seikosha, Japan

[21] Appl. No.: 707,118

[22] Filed: Jul. 21, 1976

[30] Foreign Application Priority Data

Jul. 22, 1975 Japan ..... 50-101651[U]

[51] Int. Cl.[2] ..... G04B 23/12; G04C 21/34

[52] U.S. Cl. ..... 58/57.5; 58/38 R; 58/88 R; 58/90 R

[58] Field of Search ..... 58/19 R, 23 R, 38 R, 58/38 A, 50 R, 57.5, 88 R, 90 R, 152 B

[56] References Cited

U.S. PATENT DOCUMENTS

| | | | |
|---|---|---|---|
| 3,462,943 | 8/1969 | Spadini et al. | 58/57.5 |
| 3,577,876 | 5/1971 | Spadini | 58/57.5 |
| 3,638,418 | 2/1972 | Spadini | 58/57.5 |
| 3,946,549 | 3/1976 | Cake | 58/38 R |
| 3,971,207 | 7/1976 | Murakami et al. | 58/152 B |

*Primary Examiner*—Stanley J. Witkowski

*Attorney, Agent, or Firm*—Robert E. Burns; Emmanuel J. Lobato; Bruce L. Adams

[57] ABSTRACT

An electronic wristwatch with an audible alarm device has an elongated casing in which there are two cavities separated from one another. An electronic time keeping unit is sealed in one of the cavities while an audio alarm device is housed in the other cavity. Preferably, the casing has a central portion from which opposite wing portions extend. The cavity for the time keeping unit is in the central portion while the cavity for the alarm device is in one of the wing portions. The cavity for the alarm device opens at the back of the casing and the alarm device is made up as a self-contained unit which fits into the cavity. A plurality of small holes extend from the cavity for the alarm device to the front of the casing for better transmission of sound.

6 Claims, 4 Drawing Figures

ELECTRONIC WRISTWATCH HAVING AN ALARM DEVICE

FIELD OF THE INVENTION

The present invention relates to electronic wristwatches and particularly to an electronic wristwatch having an audio alarm device.

BACKGROUND OF INVENTION

In the conventional type of electronic wristwatch having an alarm device, the alarm is mounted on or in the movement whereby the thickness of the watch is increased. Such construction is hence not applicable to thin type electronic wristwatches. Moreover, the movement of an electronic wristwatch is customarily sealed in a cavity in the watch casing so as to protect the movement against dirt and moisture. When the alarm device is mounted on or in a sealed movement, the sound of the alarm device is muffled so that it is not possible to obtain a loud alarm sound. If a loud alarm sound is wanted, the waterproof characteristics of the watch are impaired whereby the reliability of the watch is decreased. Furthermore, it is inconvenient to disassemble and assemble the watch for repair when the alarm device is incorporated with the movement.

SUMMARY OF INVENTION

It is an object of the present invention to eliminate the above noted difficulties and insufficiencies. In accordance with the invention, a thin type electronic alarm wristwatch is provided with an elongated casing having two cavities separated from one another. The electronic time keeping unit or "movement" is housed in one of the cavities while an audio alarm device is housed in the other cavity. The alarm device is controlled by leads connecting it with the movement but the two cavities are sealed from one another so that the cavity containing the movement can be moisture tight while the cavity containing the alarm device can be apertured to permit transmission of sound to the exterior. Preferably, the alarm device is constructed as a self-contained unit which is inserted from the back of the casing into the respective cavity and can be removed for inspection, servicing or repairs.

BRIEF DESCRIPTION OF DRAWINGS

The nature, objects and advantages of the invention will be more fully understood from the following description of a preferred embodiment which is illustrated by way of example in the accompanying drawings in which.

DESCRIPTION OF PREFERRED EMBODIMENT

Figure 1:
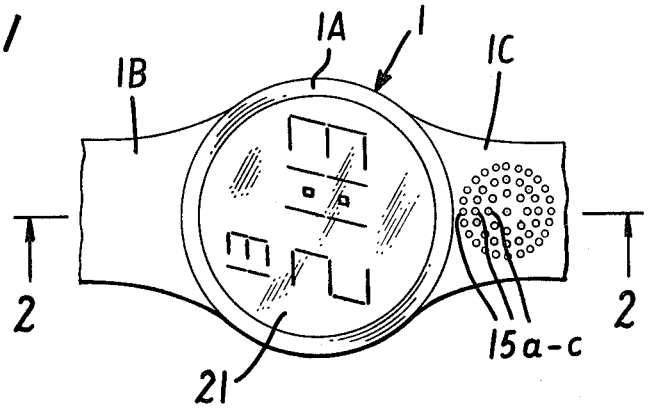
FIG. 1 is a front view of an electronic wristwatch having an alarm device in accordance with the invention.

The electronic alarm wristwatch in accordance with the present invention as illustrated by way of example in the drawings has an elongated casing 1 comprising a central or main portion 1A and two laterally extending wing portions 1B and 1C at opposite sides of the central portion 1A. As shown in cross section in FIG. 2, the watch is somewhat curved so as better to fit the wrist of a wearer, the wing portions being thereby somewhat inclined with respect to the main portion 1A. The casing 1 is provided with two cavities, namely a central cavity 2 in the main portion 1A of the casing and a side cavity 3 in one of the wing portions 1C of the casing. The central cavity 2 accommodates the "works" or movement 4 of the watch while the side cavity 3 accommodates an alarm device 5.

Figure 2:
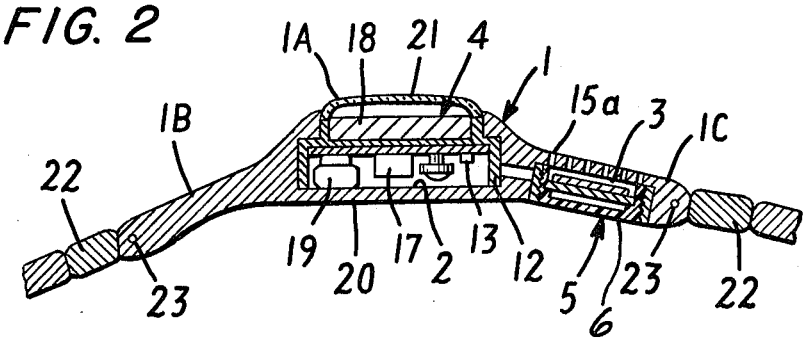
FIG. 2 is a cross sectional view taken approximately on the line 2—2 in FIG. 1.
Figure 3:
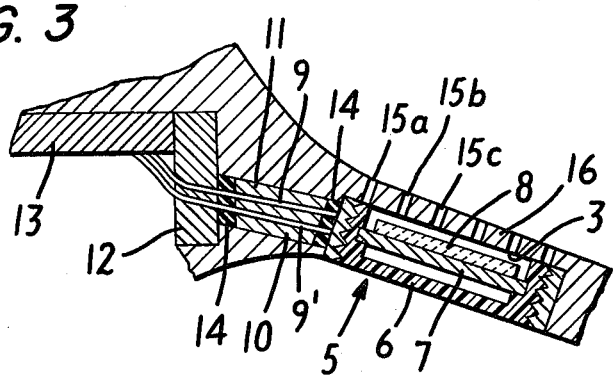
FIG. 3 is an enlargement of a portion of the cross sectional view of FIG. 2.
Figure 4:
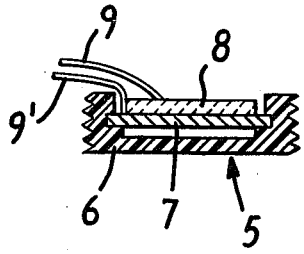
FIG. 4 is an enlarged cross sectional view of the alarm device removed from the watch case.

The side cavity 3 which is circular and internally threaded opens to the back of the casing. The alarm device 5 comprises a circular cup-shaped plastic housing 6 which is externally threaded as shown in FIG. 4 so that it can be screwed into the cavity 3 as illustrated in FIGS. 2 and 3. It will be seen that when the housing 6 is in place in the cavity 3, it is flush with the back of the watch casing 1. A vibrating plate 7 comprising a thin metal plate is supported in the housing 6 parallel to and spaced from the back of the housing. A piezoelectric element in the form of a ceramic plate 8 is mounted on the vibrating plate 7 by adhesive material. Electrode lead wires 9 and 9' are connected to the upper and lower surfaces of the piezoelectric ceramic plate 8. The leads 9 and 9' extend via a flexible printed circuit board 10 through a passage 11 in the casing and through an inner casing 12 and are connected to a printed circuit board 13 of the watch movement in the central cavity 2 of the casing. The leads are sealed by packing members 14 composed of rubber, epoxy resin or other suitable material for eliminating entry of dust or water into the central cavity 2. A plurality of small holes **15*a*, 15*b* and 15*c* are provided in the front wall 16 of the side cavity 3** for transmission of sound from the alarm device to the exterior of the watch casing.

In addition to the circuit board 12, the watch movement housed in the central cavity 2 comprises an electronic circuit 17, a liquid crystal display device 18 and a battery 19 as the power source of the electronic circuit 17, the liquid crystal display device 18 and the alarm device 5. It will be seen that the central cavity 2 which houses the watch movement opens to the front of the casing, the back being closed by an integral portion 20 of the casing. The front of the cavity 2 is closed and sealed, dirt and moisture tight by a watch glass or crystal 21. A watchband 22 is attached to the laterally outermost extremities of the opposite wing portions 1B and 1C of the casing in customary manner by pins 23.

The electronic circuit 17 as is known in digital electronic alarm watches comprises an oscillating circuit, dividing circuits, time counting circuits, an alarm setting memory circuit and a coincidence circuit. When time counting signals coincide with the alarm time set by the alarm memory circuit, an alarm signal is generated. The signal is amplified and transmitted through the electrode leads 9 and 9' to the piezoelectric element 8 of the alarm device 5. The resulting vibration of the piezoelectric ceramic plate 8 causes the plate 7 to vibrate and sound waves created by such vibration are conducted out through the holes **15*a*, 15*b* and 15*c*** to the exterior of the watch casing so as to be clearly audible to the wearer of the watch.

It will thus be seen that in accordance with the present invention, the alarm device is housed in a cavity of the casing separate from the cavity for the watch movement whereby it is possible to make the watch casing quite thin. Moreover, since the alarm device is housed in a separate cavity which is open through small holes to the atmosphere, it is possible to produce a relatively loud alarm sound. A further advantage is that the alarm device is mounted in such manner that it can be readily disassembled and assembled in the casing whereby inspection, maintenance and repair are facilitated.

While a preferred embodiment of the invention has been illustrated in the drawings and has been herein particularly described, it will be understood that many modifications can be made and that the invention is in no way limited to the illustrated embodiments.

What I claim is:

1. A wristwatch comprising an elongated watch case having a central portion with a central cavity therein and two integral side wing portions extending laterally from opposite sides of said central portion and having at their laterally outermost extremities means for connection of said side wing portions with watch band means for holding said wristwatch on the arm of a wearer, a side cavity in one of said integral side wing portions of said case, a watch movement in said central cavity, an audio alarm device in said side cavity and leads electrically connecting said audio alarm device with said watch movement, said central cavity and side cavity being isolated from one another by an intervening integral portion of said watch case.

2. A wristwatch according to claim 1, in which said watch case has a front face and a back face and in which said side cavity opens to the back face of said watch case and a plurality of small holes are provided in the front of said side cavity opening from said side cavity to the front face of said watch case.

3. A wristwatch according to claim 2, in which said audio alarm device is a unit which is removably inserted in said side cavity from the back face of said watch case and comprises a cup-shaped housing which is flush with the back face of said watch case.

4. A wristwatch according to claim 3, in which said audio alarm device burther co&prises a vibratinc plate set in said cul-shaped housing and a piezoelectric element mounted on said plate.

5. A wristwatch according to claim 3, in which said said cavity is internally threaded and in which said cup-shaped housing of said audio alarm device is externally threaded and is screwed into said side cavity.

6. A wristwatch according to claim 2, in which said central cavity opens to the front face of said watch case, and in which a watch glass closes and seals said central cavity.

* * * * *